United States Patent [19]

Paley

[11] 4,431,147

[45] Feb. 14, 1984

[54] STEERABLE ARTILLERY PROJECTILE

[75] Inventor: Isadore R. Paley, Rockaway, N.J.

[73] Assignee: The Bendix Corporation, Teterboro, N.J.

[21] Appl. No.: 334,096

[22] Filed: Dec. 24, 1981

[51] Int. Cl.[3] ..... F42B 13/32

[52] U.S. Cl. ..... 244/3.3

[58] Field of Search ..... 102/384; 244/3.1, 3.16, 244/3.3

[56] References Cited

U.S. PATENT DOCUMENTS 4,193,688 3/1980 Watkins ..... 244/3.16
4,318,515 3/1982 Leek ..... 244/3.16

FOREIGN PATENT DOCUMENTS

WO82/03453 10/1982 PCT Int'l Appl. ..... 244/3.16

OTHER PUBLICATIONS

Field Artillery Journal; "*Precision Guided Artillery, First and Second Generation Projectiles*"; James F. Hall; May-Jun. 1981; pp. 9-12.

AIAA Guidance and Control Conference; "*Copperhead Semiactive Laser Guidance System Development*"; R. A. Nulk and P. A. Morrison; Sep.-Oct. 1979; vol. 2, No. 5.

AIAA Guidance and Control Conference; "*Performance Verification of the Cannon Launched Guided Projectile Guidance and Control System*"; J. B. Huff and H. L. Pastrik; Aug. 1976; Paper No. 76-1981.

AIAA Guidance and Control Conference; "*Guidance and Control of a Cannon-Launched Guided Projectile*"; P. H. Morrison and D. S. Amberntson; Aug. 1976, Paper No. 76-1980.

*Primary Examiner*—Richard E. Schafer
*Assistant Examiner*—Maureen T. Ryan
*Attorney, Agent, or Firm*—Anthony F. Cuoco; Joseph E. Funk

[57] ABSTRACT

A steerable artillery projectile utilizing electro-optical circuitry to home on a laser designated target where the rear end of the projectile is displaceably coupled to the front end thereof which contains the electro-optical circuitry and munitions is disclosed. The displaceably coupled rear end of the projectile has a plurality of compartments equispaced around its longitudinal axis and each compartment has a gas cartridge which can be activated by the electro-optical circuitry. In flight, a selected gas cartridge may be discharged by the electro-optical circuitry causing the longitudinal axis of the rear end of the projectile to momentarily move out of line with the longitudinal axis of the front end of the projectile resulting in a modification of the flight path of the projectile to home on the laser designated target.

6 Claims, 6 Drawing Figures

STEERABLE ARTILLERY PROJECTILE

BACKGROUND OF THE INVENTION

This invention relates to steerable artillery projectiles. The prior art teaches steerable artillery projectiles. One such projectile is named "Copperhead" and is disclosed in detail in four articles and papers, along with other articles and papers cited therein, which are all incorporated herein by reference. They are: "Precision Guided Artillery, First and Second Generation Projectiles", James F. Hall, *Field Artillery Journal,* p. 9–12, May–June 1981; "Copperhead Semiactive Laser Guidance Development System", R. A. Nulk et al, *AIAA Guidance and Control Conference,* Vol 2, No. 5, Article No. 78-1261R, p. 374–381, Sept.–Oct. 1979; "Guidance and Control of a Cannon-Launched Guided Projectile", P. H. Morrison et al., *AIAA Guidance Guidance and Control Conference,* August 1976, San Diego, Calif., Paper No. 76-1980, p. 555–567; "Performance Verification of the Cannon Launched Guided Projectile Guidance and Control System", J. B. Huff et al, *AIAA Guidance and Control Conference,* August 1976, San Diego, Calif., Paper No. 76-1981, p. 568–574.

Briefly, the Copperhead projectile consists of a fuse and warhead section, steering section and a guidance seeker section. The guidance seeker has optics, a laser detector and electronic circuitry which functions with the steering section to control the flight of the projectile to home on laser energy reflected from a laser designated target.

The steering section of the Copperhead projectile is very complex. Briefly, after launch acceleration, fin retention locks are released to extend four control fins. The fins are controlled in pairs and are turned to provide steering. The steering section of the projectile also includes a battery, control actuators, an attitude reference gyro, a pneumatic bottle and other elements which are responsive to signals from the guidance section of the missile to control the fins and thereby steer the projectile to home on a laser designated target.

The steering section of this prior art missile is a very complex electromechanical arrangement, which is prone to malfunctions. Thus, there is a need in the art for a relatively simple steering arrangement that can function reliably with the electro optics seeking and guidance section.

SUMMARY OF THE INVENTION

The above problem is satisfied by my invention which provides steering capability to a projectile having electro-optical sensing and control known in the art without the need for a complex steering arrangement including controllable fins and other circuitry and hardware associated therewith presently known and used in the prior art. To implement my novel projectile steering mechanism, I provide a rear end 13 to the projectile, which rear end is displaceably coupled to the rear of the front end 9 of the projectile. Under appropriate control the displaceably coupled rear end is moved to "bend" the projectile and thereby modify its flight path to home on a target. Fins 28 are provided but their function is only to prevent any spinning of the projectile. Within the rear end of the projectile are a plurality of expandable chambers, with each chamber having wall portions 15 affixed to the projectile front end 12 and having other wall portions 16 affixed to the rear end. In each chamber is a pressure means in the form of a gas generator cartridge 17. Selected one(s) of the gas cartridges are discharged under control of the electro-optical sensing and control circuit 10 and the chamber in which a gas generator cartridge is fired is caused to expand which "bends" the projectile momentarily to modify the flight path thereof.

BRIEF DESCRIPTION OF THE DRAWING

The invention will be better understood upon reading the following detailed description in conjunction with the drawing in which.

DETAILED DESCRIPTION

Figure 1:
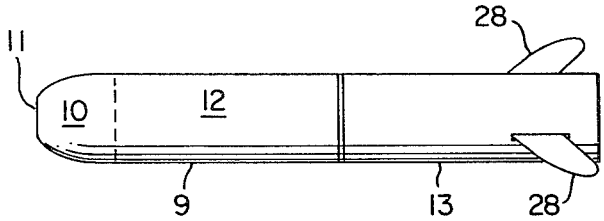
FIGS. 1 and 2 show a profile of a projectile per my invention with the displaceably coupled rear end in line with the projectile front end and also shown with the rear end displaced to affect steering of the projectile.
Figure 2:
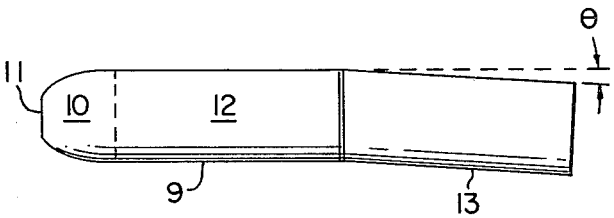

FIGS. 1 and 2 show profile drawings of my novel steerable artillery projectile. FIG. 1 shows the profile of the projectile with no "bending" of the projectile, while FIG. 2 shows the projectile bent by an exaggerated angle $\theta$ to affect steering of the projectile. The steerable artillery projectile has a front end 9 made up of an electro-optical and sensing section 10 with its optical section 11 being in the nose of the projectile. Electro-optical and sensing sections 10 are a modification of such a circuit already known in the art and used in the Copperhead projectile described in detail in the aforementioned four articles and papers. Normally rear section 13 of the projectile has its longitudinal axis coaxial with the longitudinal axis of the projectile front end 9. In response to signals from electro-optical and sensing portion 10 when the projectile is in flight its rear end 13 is moved out of its normal coaxial relationship with front end 9 by an angle $\theta$ as shown in FIG. 2 to affect steering of the projectile. The actual angle $\theta$ would typically be five degrees or less. In FIG. 2, with the projectile in flight and being bent as shown, air flow against the bottom of the rear end 13 will cause the front end of the projectile to rise in an obvious manner. Fins 28 on rear end 13 do not provide steering of the projectile as taught in the prior art. Rather, fins 28 are used to stop any spinning of the projectile around its longitudinal axis. Fins 28 are initially stored in openings in the side of rear end 13 and after the projectile clears the barrel of a smooth bore cannon from which it is fired the fins are extended as shown. Acceleration upon firing is used to release fins 28 to their extended position in a manner well known in the art and also described in the aforementioned literature covering the Copperhead projectile.

Figure 3:
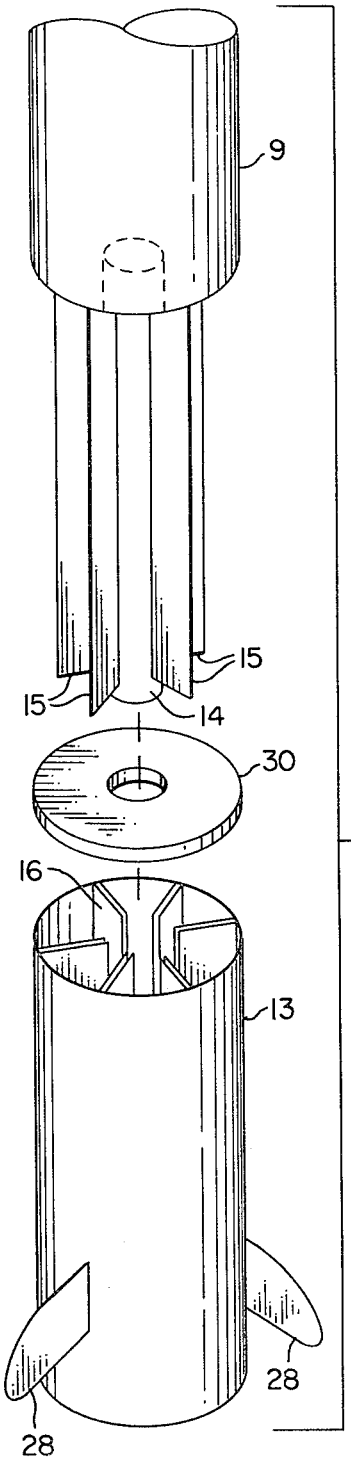
FIG. 3 is a three-dimensional view of the rear portion of the projectile front end and the projectile rear end.

Referring now to FIG. 3, at the rear of the munitions section 12 of front end 9 of the projectile is coaxially affixed a shaft 14 to which are fastened a first plurality of outwardly extending, angularly equispaced vanes 15 as shown. Rear end 13 has a second plurality of angularly equispaced vanes extending inwardly as shown. Rear end 13 mounts over shaft 14 and vanes 15 of front end 9 and is displaceably coupled to the rear of front end 9. A spring or other resilient means 30 is used to normally maintain the coaxial longitudinal axis relationship between front end 9 and rear end 13.

The resilient means 30 may comprise a flat donut shaped member having a diameter equal to the inside diameter of rear end 13. This donut shaped member is made of a stiff resilient material. When front end 9 is assembled to rear end 13, shaft 14 would pass through rear end 13 and the end of the shaft would go into the center hole of the resilient donut member which is located in the rear or bottom of rear end 13. The stiff resilient nature of the flat donut shaped member will maintain the coaxial relationship of the front and rear end of the projectile as described in the beginning of this paragraph but yields to the pressure of a fixed gas generator cartridge 17 to "bend" the projectile as described in greater detail hereinafter.

Figure 4:
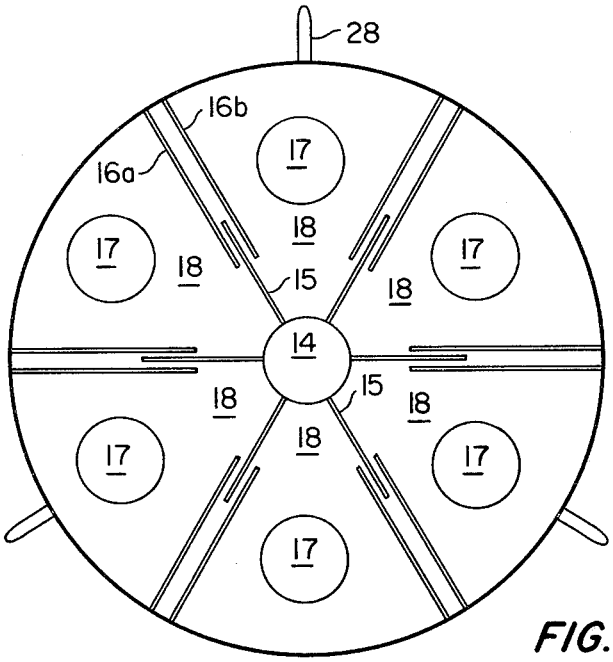
FIGS. 4 and 5 are a rear end view of the assembled projectile showing the expandable chambers created in the projectile rear end without a chamber expanded and with a chamber expanded to affect steering of the projectile.
Figure 5:
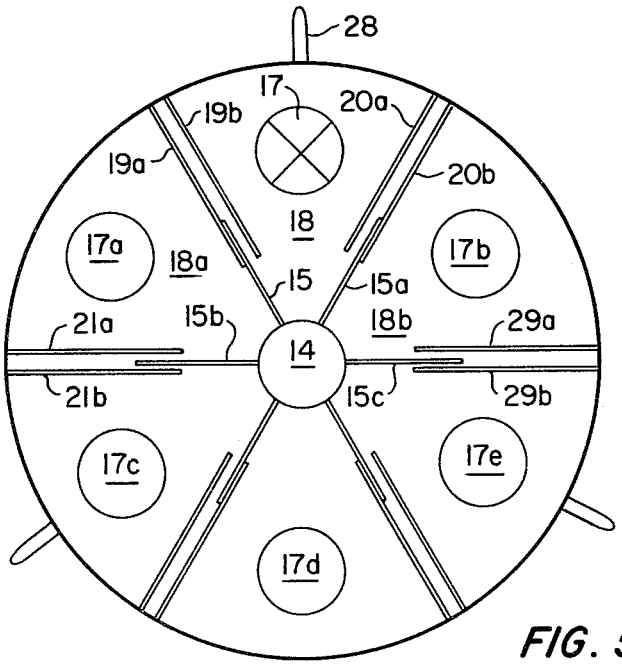

Details of the chambers created by vanes 15 and 16 are shown in FIGS. 4 and 5 which both show an internal, end view of the rear end 13 of the assembled projectile. FIG. 4 shows the internal details when the projectile is not bent, while FIG. 5 shows the internal details when the projectile is bent to affect steering.

Each vane 16 in FIG. 2 is actually two closely spaced vanes 16*a* and 16*b* as shown in FIG. 4. Upon assembly of the rear end 13 to front end 9 of the projectile each of vanes 15 is positioned between a pair of vanes 16*a* and 16*b* without touching them. The exemplary structure shown in FIGS. 4 and 5 define six chambers 18, each containing a gas cartridge 17. As vanes 15 are not connected to representative vanes 16*a* and 16*b* each vane 15 may move between the corresponding vanes 16*a* and 16*b* to expand the volume of each chamber 18.

Electro-optical and sensing section 10 "sees" the laser designated target and determines that flight path correction is needed. At an appropriate time in the flight of the projectile electro-optical and sensing section 10 generates a signal to fire or discharge an appropriate one of gas cartridges 17 to 17*e*. The sudden pressure caused by the gas from discharged gas cartridge 17 cannot all escape through the space between vanes 15, 16*a* and 16*b* so the pressure causes the chamber 18 to expand as shown in FIG. 5 until vanes touch each other and thereby "bends" the projectile to affect its flight path. The expansion of chamber 18 causes bending of the projectile until vanes 15 and 15*a* push up against vanes 19*a* and 20*b* respectively which also effectively seals chamber 18 for a period of several milliseconds to thereby accomplish projectile flight path correction. As the pressure in chamber 18 in FIG. 5 dissipates within the several millisecond period, the resilient means 30 described above causes the rear end 13 to return to its original position shown in FIG. 4 with its longitudinal axis coaxial with front end 9. Electro-optical and sensing portion 10 may thereafter fire another gas cartridge for further projectile course correction.

In FIG. 5 vanes such as 19*a* and 19*b*, or 20*a* and 20*b* are shown as pairs of vanes as mentioned previously. This is required for the proper functioning of my invention. For the example given gas cartridge 17 was fired expanding chamber 18 and vanes 15 and 15*a* expanded up against vanes 19*a* and 20*b* respectively. However, provision must be made for firing others of the gas cartridges. In the event gas cartridge 17*a* is fired vanes 15 and 15*b* need vanes 19*b* and 21*b* respectively to expand against. Similarly, firing of gas cartridge 17*b* causes chamber 18*b* to expand and and vanes 15*a* and 15*c* move against vanes 20*a* and 29*b* respectively. Without pairs of vanes this operation is not possible.

Figure 6:
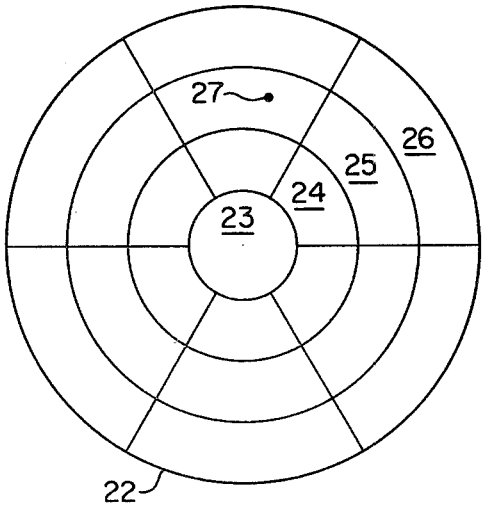
FIG. 6 is a representation of what the optics of the electro-optical section of the projectile senses.

In FIG. 6 is shown the optical view 22 seen by the projectile in the terminal phase of its flight when it "sees" the laser designated target 27. The optical view is broken up into six sections corresponding to the previously described chambers created in rear end 13 of the projectile. Each section has a number of bands, although only three bands 24, 25 and 26 are representatively shown in FIG. 6. When target 27 is in center section 23, the projectile is homing on the target. When target 27 is seen in one of the outer rings 24, 25 or 26 the electro-optical and sensing circuit 10 may operate in one of a few different ways. In the simplest version, as long as target 27 is moving from an outer ring such as ring 26 to an inner ring such as rings 24 or 25 or to center 23, circuit 10 will not fire any gas cartridges, even though the projectile may hit and explode before target 27 has moved to center section 23 for a perfect projectile hit. In a more complex preferred embodiment of the invention the approximate time of projectile flight is input to the projectile, and a programmed microprocessor (not shown) in electro-optical circuit 10 is constantly calculating the remaining projectile flight time and determines if the target will move to center 23 before projectile impact. If not, the microprocessor decides how much flight correction is needed and fires a particular gas cartridge at a calculated moment in time resulting in the target 27 being in center section 23 just before the projectile hits target 27 for a direct hit. In this latter version the microprocessor may also fire more than one gas cartridge to accomplish flight path correction.

While what has been described hereinabove is the preferred embodiment of the invention it would be obvious to those skilled in the art to make many modifications thereto without deviating from the teaching and scope of the invention.

I claim:

1. A steerable artillery projectile utilizing an electro-optical circuit mounted in the front end of the projectile to home on a target by moving the projectile rear end which comprises:

a cylindrical piece displaceably coupled to the rear of said projectile front end with the longitudinal axis of said cylindrical piece normally being coaxial with the longitudinal axis of said projectile front end, and pressure means actuated by said electro-optical circuit to move the longitudinal axis of said cylindrical piece out of its coaxial relationship with the longitudinal axis of said projectile front end resulting in a modification of the projectile flight path so that said projectile homes on said target.

2. The invention in accordance with claim 1 wherein the displaceable coupling of said cylindrical piece on the rear of said projectile front end creates a plurality of chambers within said cylindrical piece, and said pressure means comprises a like plurality of pressure means with a pressure means being in each of said chambers.

3. The invention in accordance with claim 2 wherein said chambers are formed cooperatively by an extension protruding coaxially from the rear of said projectile front end that has a first set of vanes extending radially outward and said cylindrical piece that has a second set of vanes extending radially inward, when said cylindrical piece is displaceably coupled to said projectile front end the first and second sets of vanes mesh together to form said chambers, and the actuation of one of said plurality of pressure means causes the expansion of the chamber in which it is located thereby resulting in moving the longitudinal axis of said cylindrical piece out of its coaxial relationship with the longitudinal axis of said projectile front end.

4. The invention in accordance with claim 3 wherein each of said plurality of pressure means comprises a gas generator cartridge that may be individually actuated by said electro-optical circuit.

5. A steerable artillery projectile utilizing an electro-optical circuit mounted in the front end of the projectile to home on a target by moving the projectile rear end which comprises:

a cylindrical piece fitting over an extension protruding longitudinally from the rear of the projectile front end, said extension having a first set of vanes extending radially outward from the longitudinal extension, said cylindrical piece being displaceably coupled to the projectile front end, said cylindrical piece having a second set of vanes extending radially inward toward the longitudinal axis thereof and when said cylindrical piece is displaceably coupled to the rear of said projectile front end the first and second sets of vanes mesh together to be close to but not touching each other, ones of said first set of vanes touching ones of said second set of vanes and forming a closed chamber when the longitudinal axis of said projectile front end is not coaxial with the longitudinal axis of said cylindrical piece, and a plurality of pressure means with at least one pressure means being located in each of said chambers and said pressure means may be actuated by said electro-optical circuit, the actuation of said pressure means in a chamber resulting in that chamber expanding causing said cylindrical piece to be displaced so that ones of said first and second set of vanes from a closed chamber to at least momentarily hold the pressure created by said actuated pressure means and thereby resulting in a modification of the projectile flight path so that said projectile homes on said target.

6. The invention in accordance with claims 1, 4 or 5 further comprising a resilient member maintaining the longitudinal axis of said cylindrical piece coaxial with the longitudinal axis of said projectile front end.

* * * * *